US011118520B2

(12) United States Patent
Shurkewitsch et al.

(10) Patent No.: US 11,118,520 B2
(45) Date of Patent: Sep. 14, 2021

(54) METHOD FOR CYLINDER EQUALIZATION OF AN INTERNAL COMBUSTION ENGINE

(71) Applicant: Volkswagen Aktiengesellschaft, Wolfsburg (DE)

(72) Inventors: Andre Shurkewitsch, Calberlah (DE); Robert Wetten, Berlin (DE); Elmar Millich, Berlin (DE); Jan Vogelsang, Braunschweig (DE); Nikolaus Zimbalist, Edemissen (DE); Heiko Sternberg, Wolfsburg (DE)

(73) Assignee: Volkswagen Aktiengesellschaft, Wolfsburg (DE)

( * ) Notice: Subject to any disclaimer, the term of this patent is extended or adjusted under 35 U.S.C. 154(b) by 0 days.

(21) Appl. No.: 17/006,299

(22) Filed: Aug. 28, 2020

(65) Prior Publication Data

US 2021/0062736 A1 Mar. 4, 2021

(30) Foreign Application Priority Data

Aug. 28, 2019 (DE) ..... 10 2019 212 932.3

(51) Int. Cl.
*F02D 41/00* (2006.01)
*F02D 41/14* (2006.01)
*F02P 5/14* (2006.01)

(52) U.S. Cl.
CPC ..... *F02D 41/008* (2013.01); *F02D 41/0002* (2013.01); *F02D 41/009* (2013.01); (Continued)

(58) Field of Classification Search
CPC .. F02D 41/008; F02D 41/0002; F02D 41/009; F02D 41/1448; F02D 41/1454; F02D 41/0085; F02P 5/14
See application file for complete search history.

(56) References Cited

U.S. PATENT DOCUMENTS 5,335,636 A * 8/1994 Bilei ..... F01L 13/06 123/321
6,170,465 B1 * 1/2001 Shomura ..... F02D 41/008 123/436

(Continued)

FOREIGN PATENT DOCUMENTS

DE 19814155 A1 10/1999
DE 10064651 A1 7/2002

(Continued)

*Primary Examiner* — Joseph J Dallo

(74) *Attorney, Agent, or Firm* — Muncy, Geissler, Olds & Lowe, P.C.

(57) ABSTRACT

A method and control unit for cylinder equalization of an internal combustion engine having at least two cylinders, and includes the following steps: Determination of exhaust gas back pressure values of the individual cylinders over at least two operating cycles, correlation of the exhaust gas back pressure values with the camshaft position and/or the operating cycle, determination of the exhaust gas back pressure maxima for each cylinder, comparison of the exhaust gas back pressure maxima between the individual cylinders and detection of differences, adjustment of the cylinder-specific charge quantities of fresh air and/or fuel. In addition, the invention relates to a controller for carrying out the method and a motor vehicle having such a controller. The method improves the previously known methods and makes them more efficient, especially with regard to the efficiency of the combustion process and thus also of exhaust-gas aftertreatment.

12 Claims, 1 Drawing Sheet

(52) U.S. Cl.
CPC ..... *F02D 41/1448* (2013.01); *F02D 41/1454* (2013.01); *F02P 5/14* (2013.01)

(56) References Cited

U.S. PATENT DOCUMENTS

| | | | | |
|---|---|---|---|---|
| 6,302,083 | B1 | 10/2001 | Kärcher et al. | |
| 6,587,769 | B2 | 7/2003 | Otterbach et al. | |
| 6,681,729 | B2 | 1/2004 | Gaessler et al. | |
| 6,981,492 | B2 | 1/2006 | Barba et al. | |
| 7,946,162 | B2 | 5/2011 | Vennettilli et al. | |
| 9,932,915 | B2 | 4/2018 | Gaenzle et al. | |
| 2009/0018756 | A1* | 1/2009 | Storhok | F02D 41/0082 701/105 |
| 2014/0048025 | A1* | 2/2014 | Watanabe | F01L 1/34 123/90.15 |
| 2016/0160811 | A1* | 6/2016 | Deb | F02M 26/43 123/568.2 |
| 2017/0175598 | A1* | 6/2017 | Ebert | F02D 17/02 |
| 2017/0175665 | A1* | 6/2017 | Ebert | F01L 1/185 |
| 2018/0119622 | A1* | 5/2018 | Nair | F01L 1/181 |
| 2019/0085782 | A1 | 3/2019 | Brahma et al. | |
| 2019/0293011 | A1* | 9/2019 | Kang | F02D 41/0235 |

FOREIGN PATENT DOCUMENTS

| | | | | |
|---|---|---|---|---|
| DE | 10115902 | C1 | 7/2002 | |
| DE | 10158262 | A1 | 6/2003 | |
| DE | 10362028 | B4 | 9/2009 | |
| DE | 102013218308 | A1 | 3/2015 | |
| DE | 102014211162 | A1 | 12/2015 | |
| DE | 102014219483 | A1 | 3/2016 | |
| EP | 2722498 | A1 * | 4/2014 | F01L 1/18 |
| EP | 2098710 | B1 | 7/2016 | |

* cited by examiner

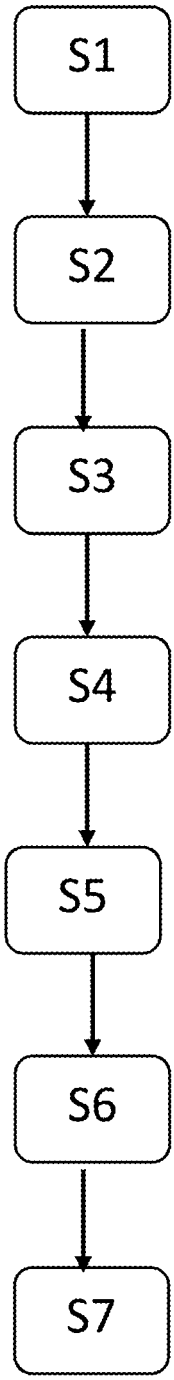
S1
S2
S3
S4
S5
S6
S7

METHOD FOR CYLINDER EQUALIZATION OF AN INTERNAL COMBUSTION ENGINE

This nonprovisional application claims priority under 35 U.S.C. § 119(a) to German Patent Application No. 10 2019 212 932.3, which was filed in Germany on Aug. 28, 2019, and which is herein incorporated by reference.

BACKGROUND OF THE INVENTION

Field of the Invention

The present invention relates to a method for cylinder equalization of an internal combustion engine and to a control unit.

Description of the Background Art

Present-day emission control regulations require ever more accurate fuel pre-control. Precise calculation methods in the engine control unit have already been introduced and are constantly being improved for this purpose. However, the precise knowledge of camshaft positions, pressure and temperature values, and additional input quantities is a prerequisite for exact calculation of the necessary fuel quantity. Despite all efforts, however, components such as the cylinder head, the camshafts, and the pressure and temperature sensors remain subject to tolerances. In addition, cylinder-specific differences in the captured fresh air mass result from pressure waves in the intake manifold and in the exhaust manifold and also from intake and exhaust passages of different lengths and from their temperature effects. These cylinder-specific differences cannot currently be detected during vehicle operation through the conventional measurement and calculation methods. In operation, this leads to a cylinder-specific fuel/air ratio that does not correspond to the desired, optimal value, but instead is only averaged over all cylinders as a mean value. Especially in the case of the gasoline engine, however, care must be taken that the fuel/air ratio corresponds to the stoichiometric ratio, since the catalytic converter has the highest conversion rate here. If the unequal distribution between the cylinders becomes too great, then the catalytic converter can no longer convert the emissions, and leakages occur.

In order to overcome this disadvantage, it is known to take cylinder-specific cam offsets into account in the engine control models. Another known remedy is the overdimensioning of the catalytic converter storage. If the storage capacity of the catalytic converter for nitrogen oxides, hydrocarbons, and carbon monoxide is large enough, certain unequal distributions can be at least partially compensated by this means.

Several different engine control models are known that perform an adjustment or correction of model parameters.

Thus DE 101 58 262 A1, for example, describes a generic method for determining a multiplicity of parameters using suitable models that are incorporated into the control of the internal combustion engine, and monitor and optimize them. In particular, the charging of the combustion chamber of the internal combustion engine with the supplied gas mixture of fresh air and recirculated exhaust gas is simulated by means of a physics-based model.

DE 103 62 028 B4, which corresponds to U.S. Pat. No. 6,981,492, likewise describes a method for determining a fresh gas quantity while taking into account an exhaust gas recirculation quantity, and includes a temperature-based correction.

In another model-based method according to EP 2 098 710 B1, which corresponds to U.S. Pat. No. 7,946,162, the oxygen concentration is estimated in an internal combustion engine with exhaust gas recirculation, wherein the air mass that enters the cylinders, as one of the important parameters, and the estimation of the total gas flow that enters the cylinders, are used.

The known measures, however, only take into account some causes of unequal distributions between cylinders such as, e.g., cam offsets, however. But many overlapping effects are often the cause. The disadvantages with overdimensioned catalytic converters are, firstly, the costly coatings with precious metals and, secondly, the requirement for space, which is often limited. A large catalytic converter likewise needs a greater heat input to achieve its light-off temperature. The catalytic converter only helps to reduce emissions to a limited degree in a cold start, because it has not yet reached its operating temperature.

SUMMARY OF THE INVENTION

It is therefore an object of the present invention to provide a method and a control unit for cylinder equalization of an internal combustion engine that at least partially overcome the disadvantages of the prior art.

Thus, provided is a method for cylinder equalization of an internal combustion engine having at least two cylinders and a control unit for cylinder equalization of an internal combustion engine, wherein the control unit is designed to carry out a method according to the first aspect.

In the operation of gasoline engines, the most precise possible measurement of the current cylinder air charge plays a central role in order to deliver the fuel mass by injection as exactly as possible in the stoichiometric ratio so that a lambda value takes on the value one, thus minimizing pollutant emissions. In the case of diesel engines, precise determination of the cylinder charge is likewise increasingly important on account of emission control legislation. For this reason, the cylinder air charge is generally calculated in the engine control unit from a measured or modeled intake manifold pressure, a measured or modeled exhaust gas back pressure, and models for the residual gas content in the cylinder. In addition, the calculation of the cylinder air charge incorporates the current positions of actuators that affect the charge, for example the positions of the intake and exhaust camshafts, the swirl flaps, the valve strokes, and other positions, as well as intake air and exhaust gas temperatures. Another important parameter in calculating the current cylinder charge is the exhaust gas back pressure directly after the exhaust valves, since this has a major influence on the residual gas rate in the combustion chamber. In this context, the exhaust gas back pressure averaged over a segment of an operating cycle is typically considered in the case of sensor-based methods. It is not possible to determine differences in cylinder air charge between the individual cylinders in this way, however, in particular those that are subject to fluctuations dependent on the operating point.

Against this background, provision is now made according to the invention to provide a method with which a cylinder equalization of the internal combustion engine can be performed such that the following steps are carried out: Determination of exhaust gas back pressure values of the individual cylinders over at least two operating cycles, correlation of the exhaust gas back pressure values with the camshaft position and/or the operating cycle, determination of the exhaust gas back pressure maxima for each operating cycle, comparison of the exhaust gas back pressure maxima between the individual cylinders and detection of differences, adjustment of the cylinder-specific charge quantities of fresh air and/or fuel.

The term "cylinder equalization," for the purposes of the present invention, includes, for example, that every cylinder of the internal combustion engine is operated with a stoichiometric fuel/air ratio. Disparities in the charge quantities, especially in the charge quantity of fresh air, are recognized and compensated with the method according to the invention.

The internal combustion engine can be a gasoline engine or a diesel engine.

The exhaust gas back pressure can be measured in the exhaust duct, preferably adjacent to the exhaust valve, by an exhaust back pressure sensor, or can be calculated, for example on the basis of multiple measured values that are measured during the operating cycle.

The operating cycle (also referred to as working cycle) can comprise the steps intake, compression, power, exhaust. In a four-stroke engine, for example, one operating cycle of the internal combustion engine extends over two crankshaft rotations.

The correlation of the exhaust gas back pressure values with the camshaft position and/or the operating cycle can be accomplished by the communication of the time period, the operating cycles, and/or the camshaft or crankshaft positions by the relevant sensing devices to a control unit that is carrying out the method. Produced as a result, in particular, is a curve of exhaust gas back pressure over crankshaft angle.

In determining the exhaust gas back pressure maxima for each cylinder, a maximum can be determined by a comparison of the exhaust gas back pressure values within a certain time range. In particular, a first maximum of the values can be determined after the opening of the exhaust valve by successively comparing the values with one another. The position of the evaluation range depends on the exhaust camshaft position and the rotational speed. In particular, the maximum of the exhaust gas back pressure is determined directly after the opening of the exhaust valve in each case.

The exhaust gas back pressure maxima thus determined are associated with the individual cylinders. This can also be done on the basis of the parameters for the relevant cylinder that are sent to the control unit, as for example the crankshaft angle, the time of the opening of the exhaust valve, the firing order, or the mass flow rates.

A predetermined relationship exists between the exhaust gas back pressure and the quantity of the charge component, in particular the cylinder air charge and the captured fresh air. This relationship can be essentially constant, or at least uniquely defined, over a predetermined exhaust gas back pressure range. In order to define the relationship, a characteristic map produced using measurement data can be stored in the calculation algorithm, for example.

Finally, an adjustment of the cylinder-specific charge quantities of fresh air and/or fuel for each cylinder takes place according to the invention. This can be accomplished, for example, through corresponding actuating signals from the engine control unit to the corresponding actuators, such as intake valves and/or fuel injectors.

The exploitation of the relationship between the quantity of the charge component, in particular of the captured fresh air, and the exhaust gas back pressure makes the method described robust against systematic and stochastic errors in a measured value acquisition by an exhaust back pressure sensor. Moreover, the fixed, predetermined relationship between the quantity of the charge component, in particular of the captured fresh air, and the exhaust gas back pressure reduces computational effort and memory requirements for the calculation of the air mass in an engine control unit.

In other words, a concept of the present invention is to detect and quantify unequal cylinder distribution, in particular with regard to the captured fresh air, by means of the exhaust back pressure sensor. It was discovered that a direct relationship exists between maximum exhaust gas back pressure during the exhaust pulse, which is to say shortly after the exhaust valve opens, and the captured air mass. The comparison of the maximum exhaust gas back pressure between the cylinders after opening of the exhaust valve thus makes it possible to deduce the differences in the captured air masses. The reason for the unequal distribution is irrelevant here. In order to also be able to estimate the unequal distribution in absolute terms, this relationship is measured on an engine on the engine test stand and stored. Consequently, a cylinder-specific adjustment of the charge can be accomplished on the basis of the results calculated by this means with respect to the unequal distribution of the cylinder charge.

The invention described here thus permits a quantitative statement about how the fresh air charge differs between the cylinders. There are a variety of possible causes, as for example a fouling of the intake valve, or a combination of different causes may be involved. Known measures often relate to individual hardware components. Differences between the cylinders due to pressure waves and temperature effects cannot be sensed by this means, however. The effect on the captured fresh air charge can also change as a function of operating point. However, with the method according to the invention it is possible to detect and quantify the differences regardless of cause. For example, it is possible in this way to adjust the charge quantities in a cylinder-specific manner in order to achieve maximally optimal combustion, efficiency, and exhaust-gas aftertreatment. As a result, low exhaust emissions can be achieved through the cylinder equalization according to the invention. Moreover, improved engine smoothness can be achieved through better torque uniformity between the cylinders.

In some embodiments of the method, the method can include the following steps:

a) Measurement of the exhaust gas back pressure, b) Correlation of the measured values with the time and/or the camshaft position and/or the operating cycle, c) Determination of the maxima of the correlation curve from step b), d) Association of the maxima with at least one, preferably with every, individual cylinder, e) Correlation of the maxima with the individual cylinder charge, f) Comparison of the maxima and/or cylinder charge between the cylinders, and g) Adjustment of the cylinder-specific charge with fresh air and/or fuel.

A cylinder-specific ignition angle correction can be carried out on the basis of the identified differences of the cylinders.

In addition, a saving in fuel consumption can be achieved through a cylinder-specific ignition angle correction, which can be carried out on the basis of the identified cylinder-specific differences.

The method according to the invention can additionally include a receiving of a sensor signal with a high sampling rate in terms of time from a high-resolution exhaust back pressure sensor, wherein the sensor signal represents the exhaust gas back pressure. The sampling rate can be in the range from 0.5 kHz to 3000 kHz, in particular in the range from 1 kHz to 1000 kHz. The sensor values are stored in an array. Each array entry is associated with a specific crankshaft angle. Maxima of the values for each cylinder can thus be determined very precisely and the differences in the maxima can provide precise statements about the differences in the cylinders with respect to the charge components. The camshaft position is used to select from the 720° crankshaft angle window a range, for example 30° to 50°, that is selected for the maximum determination. It is also possible to detect small differences, which subsequently make possible the basis for an accurate cylinder equalization and a precise adjustment of charge quantities, in particular of fresh air and fuel.

The method according to the invention can additionally include that a cylinder lambda equal to 1 and an exhaust lambda equal to 1 are specified in the adjustment of the cylinder-specific charge quantities of fresh air and/or fuel.

In contrast to conventional injection behavior, in which all cylinders receive the same quantity of injected fuel at a specified exhaust lambda equal to 1, with the equalization method according to the invention it is possible to determine and inject a cylinder-specific fuel quantity.

By these means, it is possible, for example, to achieve an engine-averaged increase in the induced mean pressure, in particular for low rotational speeds. Use of the method according to the invention likewise brings about an engine-averaged reduction in specific fuel consumption. Moreover, it can be shown that use of the method according to the invention results in an engine-averaged increase in the exhaust gas temperature, so that exhaust-gas treatment can be made more efficient.

The present invention further relates to a control unit for cylinder equalization of an internal combustion engine having at least two cylinders. The control unit is designed to receive the exhaust gas back pressure values of the individual cylinders over at least two operating cycles, to perform a correlation of the exhaust gas back pressure values with the camshaft position and/or the operating cycle, to determine the exhaust gas back pressure maxima for each cylinder, to compare the exhaust gas back pressure maxima between the individual cylinders and to detect the differences between them, and to adjust the cylinder-specific charge quantities of fresh air and/or fuel.

The object of the electronic engine control unit is to control all actuators of the engine management system to achieve best possible engine operation with respect to fuel consumption, exhaust emissions, performance, and ride quality. In order to achieve this, many operating parameters must be detected with sensors and processed with algorithms (these are computing processes that run according to a defined pattern). Produced as a result are waveforms with which the actuators are controlled.

Through sensors and set point transmitters, the electronic engine control unit acquires the operating data necessary for control and regulation of the engine. Set point transmitters (e.g., switches) detect settings made by the driver, such as the position of the ignition key in the ignition lock, the control setting for the climate control, and the position of the control lever for the cruise control. Sensors detect physical and chemical quantities, and thus provide information about the current operating state of the engine.

These are examples of such sensors:

- speed sensor for detecting the crankshaft position and calculating the engine speed,
- phase sensor for detecting the phase position (operating cycle of the engine) and the camshaft position in engines with camshaft phase adjusters for adjusting the camshaft position,
- engine-temperature and intake air temperature sensor for calculating temperature-dependent correction quantities,
- knock sensor to detect engine knocking,
- air-mass sensor and intake manifold pressure sensor for charge sensing,
- exhaust back pressure sensor for measuring the exhaust gas back pressure, e.g., ahead of the turbine,
- exhaust gas temperature sensor,
- air-mass sensor,
- lambda sensor for lambda control.

The signals of the sensors can be digital, pulsed, or analog voltages. All of these signals are processed by input circuits in the control unit or increasingly also in the sensor in future. The circuits perform an adjustment of the voltage level, thereby adjusting the signals for further processing in a microcontroller of the control unit.

Signal processing in the control unit includes, for example, calculation of injection, charge control, calculation of the ignition and closing angles, charge calculation, idle speed control, lambda control, knock control, control of the fuel vapor recirculation system, boost pressure control, the immobilizer, cruise control, and speed limiting.

The controller can have a processor, for example a microprocessor, that is designed to carry out the method described for cylinder equalization of an internal combustion engine. The controller can additionally have a data memory, in which preferably a program is stored that contains instructions for the processor in order to control the latter in accordance with the method described. The predetermined relationship and/or predetermined parameters for carrying out the method described, for example the cylinder volume, can additionally be stored in the data memory.

The control unit can be integrated into an engine control module of the motor vehicle. Alternatively, the controller can be designed as a separate unit.

The controller can include an exhaust back pressure sensor or be connectable to an exhaust back pressure sensor, for example through one of the signal inputs. The exhaust back pressure sensor in this case can be designed to output a sensor signal with a high sampling rate in terms of time that represents the exhaust gas back pressure.

The present invention also relates to a motor vehicle with an internal combustion engine and a controller for cylinder equalization of the internal combustion engine as described above. The internal combustion engine has at least two cylinders, each with one intake valve by which the cylinder is connected to an air inlet, and each with one exhaust valve by which the cylinders are connected to an exhaust duct. The internal combustion engine can be a gasoline engine. The internal combustion engine can be a diesel engine, which preferably can be operated with an extended variability in the valve timing and/or utilizes an internal exhaust gas recirculation.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWING

The present invention will become more fully understood from the detailed description given herein below and the accompanying drawings which are given by way of illustration only, and thus, are not limitive of the present invention, and wherein the sole FIGURE is a highly schematic representation of a flowchart of a method according to the invention for cylinder equalization.

DETAILED DESCRIPTION

In the FIGURE a flowchart of a method for cylinder equalization of an internal combustion engine is shown in an exemplary embodiment.

At S1, a sensor signal that represents the exhaust gas back pressure is received from a high-resolution exhaust back pressure sensor. The exhaust back pressure sensor is designed to measure the exhaust gas back pressure with a high sampling rate in terms of time. The sensor signal thus provides values for the exhaust gas back pressure for multiple points in time of one, but preferably several, working cycles of the internal combustion engine.

At S2, a correlation of the measured values of the exhaust back pressure sensor with the time and/or the camshaft position and/or the operating cycle is carried out. The signal processing thus performed produces a curve of the exhaust gas back pressure, for example over the values of the crankshaft angle.

At S3, a determination of the extreme points is carried out, and the relevant maxima of the curves from S2 are determined. Preferably, the maxima are each determined directly after the opening of the exhaust valve for this purpose.

At S4, an association of the maxima to the individual cylinders is carried out. This can be accomplished on the basis of the crankshaft angle or in correlation with the camshaft positions, for example. A plausibility test of the association thus found with additional operating parameters can follow.

At S5, a correlation of the maxima of the exhaust gas back pressure of each cylinder with the individual cylinder charge in each case is carried out. This can be accomplished in a model-based manner. It can also be accomplished using a stored characteristic map that was measured beforehand, for example on a test stand.

Optionally, a normalization of the values thus processed can be carried out, for example with a residual gas quantity and/or the speed as the normalization quantity.

At S6, a comparison is optionally undertaken of the normalized or non-normalized values from step S5, which yields the cylinder-specific differences of either the maxima of the exhaust gas back pressure values, or especially preferably of the relevant cylinder charge quantities.

The identified cylinder-specific charge quantities can be used at S7 as a basis for adjusting the future cylinder-specific charge quantities of fresh air and/or fuel. Preferably, optimized charge quantities can now be introduced into the applicable cylinder with a requirement for minimum forced amplitude of the cylinder lambda value and of the exhaust lambda value.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A method for cylinder equalization of an internal combustion engine having at least two cylinders, the method comprising:

determining exhaust gas back pressure values of each individual cylinder of the at least two cylinders over at least two operating cycles based on physical parameters for each individual cylinder of the at least two cylinders;

correlating the exhaust gas back pressure values with a camshaft position or an operating cycle;

determining an exhaust gas back pressure maxima for each individual cylinder of the at least two cylinders;

comparing the exhaust gas back pressure maxima between the individual cylinders of the at least two cylinders and detecting differences; and adjusting the cylinder-specific charge quantities of fresh air and/or fuel of each individual cylinder of the at least two cylinders.

2. The method according to claim 1, wherein the exhaust gas back pressure in an exhaust duct of an individual cylinder of the at least two cylinders is measured adjacent to an exhaust valve by an exhaust back pressure sensor.

3. The method according to claim 1, further comprising:

measuring the exhaust gas back pressure values;

correlating the measured values with time and/or the camshaft position and/or an operating cycle;

determining the maxima of the correlation curve from the correlating step;

associating the maxima with at least one or every individual cylinder of the at least two cylinders;

correlating the maxima with the individual cylinder charge;

comparing the maxima and/or cylinder charge between each of the individual cylinders of the at least two cylinders; and adjusting the cylinder-specific charge with fresh air and/or fuel.

4. The method according to claim 1, wherein a cylinder-specific ignition angle correction is carried out on the basis of the identified differences of the cylinders.

5. The method according to claim 4, wherein the determination of the exhaust gas back pressure values of the individual cylinders is accomplished via a high-resolution exhaust back pressure sensor.

6. The method according to claim 5, wherein a sampling rate of the exhaust back pressure sensor is in a range from 0.5 kHz to 3000 kHz, or in a range from 1 kHz to 1000 kHz.

7. The method according to claim 1, wherein a cylinder lambda equal to 1 and an exhaust lambda equal to 1 are specified in the adjustment of the cylinder-specific charge quantities of fresh air and/or fuel.

8. A control unit for cylinder equalization of an internal combustion engine, wherein the control unit performs the method according to claim 1.

9. The control unit according to claim 8, wherein the control unit includes at least one exhaust back pressure sensor or is connectable to at least one exhaust back pressure sensor, and wherein each exhaust back pressure sensor outputs a sensor signal with a high sampling rate in terms of time that represents the exhaust gas back pressure for each individual cylinder of the at least two cylinders.

10. A motor vehicle comprising:

an internal combustion engine that includes the at least two cylinders, each of the at least two cylinders having at least one intake valve by which the at least two cylinders are connected to an air inlet, and each of the at least two cylinders having at least one exhaust valve by which each cylinder of the at least two cylinders is connected to an exhaust duct; and the control unit according to claim 8 for cylinder equalization of the internal combustion engine.

11. The method according to claim 1, wherein the adjusting the cylinder-specific charge quantities of fresh air and/or fuel of each individual cylinder of the at least two cylinders is based on the exhaust gas back pressure values.

12. The method according to claim 1, wherein the determining the exhaust gas back pressure values includes measuring the exhaust gas back pressure values at an opening of an exhaust valve of each individual cylinder of the at least two cylinders.

* * * * *